US008801454B2

(12) United States Patent
Kagotani

(10) Patent No.: US 8,801,454 B2
(45) **Date of Patent: *Aug. 12, 2014**

(54) CONNECTOR GUIDE MEMBER AND ELECTRICAL CONNECTOR DEVICE HAVING THE SAME

(71) Applicant: Hirose Electric Co., Ltd., Tokyo (JP)

(72) Inventor: Koichi Kagotani, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/788,607

(22) Filed: Mar. 7, 2013

(65) Prior Publication Data

US 2013/0183850 A1 Jul. 18, 2013

Related U.S. Application Data

(62) Division of application No. 12/972,970, filed on Dec. 20, 2010, now Pat. No. 8,425,250.

(30) Foreign Application Priority Data

Dec. 21, 2009 (JP) ..... 2009-289049

(51) Int. Cl.
*H01R 13/64* (2006.01)

(52) U.S. Cl.
USPC ..... 439/378; 439/680 H

(58) Field of Classification Search
USPC ..... 439/135–142, 246–248, 374, 377–379, 439/629, 680, 681
See application file for complete search history.

(56) References Cited

U.S. PATENT DOCUMENTS

| | | | | |
|---|---|---|---|---|
| 3,325,771 | A | | 6/1967 | Ruehlemann et al. |
| 3,601,770 | A | | 8/1971 | Bowley |
| 4,530,561 | A | | 7/1985 | Tyree et al. |
| 4,544,225 | A | | 10/1985 | Raus et al. |
| 4,572,602 | A | | 2/1986 | Rupnik |
| 4,586,254 | A | | 5/1986 | Ammon et al. |
| 4,722,698 | A | | 2/1988 | Modschiedler |
| 4,998,897 | A | | 3/1991 | Rose |
| 5,123,859 | A | | 6/1992 | Davis et al. |
| 5,147,226 | A | | 9/1992 | Kile |
| 5,356,300 | A | | 10/1994 | Costello et al. |
| 5,466,171 | A | | 11/1995 | Bixler et al. |
| 5,651,697 | A | | 7/1997 | Cinquegrani et al. |
| 5,697,799 | A | * | 12/1997 | Consoli et al. ..... 439/181 |
| 5,697,805 | A | | 12/1997 | Orstad et al. |
| 5,785,536 | A | | 7/1998 | McCartin et al. |
| 5,921,811 | A | | 7/1999 | Hsu |

(Continued)

FOREIGN PATENT DOCUMENTS

| | | | |
|---|---|---|---|
| JP | 2005-302535 | A | 10/2005 |
| JP | 2006-004842 | A | 1/2006 |
| TW | M246831 | | 10/2004 |
| TW | M322082 | | 11/2007 |

*Primary Examiner* — Thanh Tam Le
(74) *Attorney, Agent, or Firm* — Kubotera & Associates, LLC

(57) ABSTRACT

A connector guide member is provided for guiding a connector attached on a circuit board to a mating connector attached on another circuit board when the connector is connected to the mating connector. The connector guide member includes a positioning member that sets a position of the connector relative to the mating connector; an engaging member that locks to the connector while the positioning member positions the connector, and a guiding member that guides a guided portion provided on the mating connector.

8 Claims, 6 Drawing Sheets

(56) References Cited

U.S. PATENT DOCUMENTS

| | | | | |
|---|---|---|---|---|
| 6,042,423 | A | 3/2000 | Murr et al. | |
| 6,210,218 | B1 | 4/2001 | Chang | |
| 6,210,225 | B1 | 4/2001 | Cai et al. | |
| 6,334,794 | B1 | 1/2002 | Crane, Jr. et al. | |
| 6,619,968 | B2 | 9/2003 | Xu | |
| 6,948,954 | B1 * | 9/2005 | Fan | 439/137 |
| 6,971,891 | B1 * | 12/2005 | Huang | 439/137 |
| 7,101,202 | B2 * | 9/2006 | Fan | 439/137 |
| 7,134,888 | B2 * | 11/2006 | Fan | 439/137 |
| 7,140,892 | B2 * | 11/2006 | Takeuchi | 439/138 |
| 7,273,382 | B2 | 9/2007 | Igarashi et al. | |
| 7,458,837 | B2 | 12/2008 | Mineo | |
| 7,789,702 | B1 | 9/2010 | Xiang et al. | |
| 8,152,562 | B2 | 4/2012 | Gross | |
| 8,608,503 | B2 * | 12/2013 | Kagotani | 439/378 |
| 2003/0077929 | A1 | 4/2003 | Funatsu | |

* cited by examiner

CONNECTOR GUIDE MEMBER AND ELECTRICAL CONNECTOR DEVICE HAVING THE SAME

CROSS-REFERENCE TO RELATED APPLICATIONS

This is a divisional application of a prior application Ser. No. 12/972,970, filed Dec. 20, 2010, allowed.

BACKGROUND TECHNOLOGY AND RELATED TECHNOLOGY

The present invention relates to a connector guide member for guiding a connector and a mating connector to a normal fitting position thereof when the connector is connected to the mating connector.

When a conventional connector is connected to a conventional mating connector, in order to guide the conventional connector and the conventional mating connector to correct fitting positions, a conventional connector guide member may be used in some cases. Especially, when the conventional connector and the conventional mating connector are respectively mounted on circuit boards and the circuit boards are in a state of being parallel to each other, the circuit boards may block sight of the conventional connector and the conventional mating connector.

Accordingly, upon positioning the conventional connector and the conventional mating connector to fit to each other, it may be difficult to fit the conventional connector and the conventional mating connector. Accordingly, the conventional connector guide member has a dimension and is arranged so that the conventional connector and the conventional mating connector can be easily seen.

Patent Reference has disclosed a guide pin. In Patent Reference, two circuit boards are arranged not in parallel but perpendicular to each other. Therefore, it is relatively easy to see fitting positions, and the guide pin is used as a conventional connector guide member so as to easily connect the conventional connector and the conventional mating connector.

Patent Reference: Japanese Patent Publication No. 2005-302535

More specifically, in Patent Reference, three connectors are arranged as a group being tightly close to each other in a row in each of the two circuit boards arranged perpendicular to each other. A guide bush is attached to one of the circuit boards to contact with both side faces of the group of the connectors. A guide pin protruding higher than a connector fitting height is attached to the other of the circuit boards at a position corresponding to the guide bush. When the conventional connector is connected to the conventional mating connector, the guide bush and the guide pin guide the conventional connector and the conventional mating connector to correct fitting positions.

In the conventional connector guide member disclosed in Patent Reference, the guide bush is attached to the circuit board to contact the both sides of the three connectors. Accordingly, the guide bush is disposed at a fixed position relative to the connector. Therefore, it is difficult to accurately position the guide bush in relative to the connectors. In addition, until the guide bush is attached to the circuit board, the position of the guide bush is not stable, thereby causing an error in the final positioning. Furthermore, it is difficult to accurately attach the guide bush to the circuit board, thereby causing an error upon positioning.

In the conventional connector guide member disclosed in Patent Reference, the guide bush may be formed integrally with the connector, so that it is possible to accurately position and simply handle the guide bush. However, in this case, in an application where the guide bush is not necessary, the connector has a large size because of the guide bush, thereby increasing a surrounding space and a cost.

In view of the problems of the conventional connector guide described above, an object of the invention is to provide a connector guide member capable of easily and accurately guiding a connector to a fitting position in relative to a mating connector, and a connector device having the connector guide member.

Further objects and advantages of the invention will be apparent from the following description of the invention.

SUMMARY OF THE INVENTION

In order to attain the objects described above, according to a first aspect of the present invention, a connector guide member is provided for guiding a connector attached on a circuit board to a mating connector attached on another circuit board when the connector is connected to the mating connector.

In the first aspect of the present invention, the connector guide member includes a positioning member that sets a position of the connector relative to the mating connector; an engaging member that locks to the connector while the positioning member positions the connector, and a guiding member that guides a guided portion provided on the mating connector.

In the first aspect of the present invention, the connector guide member having the above configuration is attached to the connector only when the connector incorporated in an electronic circuit is necessary for fitting to the mating connector. In this case, the connector guide member is locked to the connector by the engaging member so as not to come off therefrom, while the position is set in relative to the mating connector by the positioning member. Upon fitting the connector to the mating connector, first, the guiding member of the connector guide member guides the both connector to fitting positions in concert with the guided portion in the mating connector. As the guiding member of the connector guide member further guides the both connector, the both connectors fit to each other.

In the first aspect of the present invention, regardless of a height of the guiding member of the connector, it is possible to select and set a height of the guiding member of the connector guide member. Accordingly, even if the both connectors are mounted on the circuit boards, it is possible to easily position the corresponding section of the mating connector to be guided to the guiding member in a lateral direction.

According to a second aspect of the invention, the guide section may be a guide hole for engaging a guide pin formed as a section to be guided at the mating connector, or may be a guide pin to be fit into a guide hole formed as a section to be guided in the mating connector.

According to a third aspect of the invention, the positioning section may have a face-contacting section that contacts with at least a part of an outer circumferential section of the connector, or may be formed in a fitting hole that contacts with the outer circumferential face of the connector.

In the third aspect of the present invention, the positioning section has the face-contacting section that contacts with a part of the outer circumferential face of the connector. In this case, a plurality of connector guide members is attached to the connector at an interval corresponding to a size of the connector. Accordingly, it is possible to use the connector guide member to the connector having a different size.

In the third aspect of the present invention, the positioning section is formed in the fitting hole that contacts with the outer circumferential face of the connector. In the case, the connector guide member may be used in the connector having the outer circumferential face that matches to the fitting hole. The fitting hole positions at the whole circumference of the outer circumferential face of the connector, so that the positioning can be stable.

According to a fourth aspect of the present invention, a shutter member may be provide at an opening portion of the fitting hole for closing the opening portion when the connector is disconnected from the mating connector. With the shutter member, it is possible to cover the fitting hole with the shutter member until fitting to the mating connector, whereby it is possible to prevent dust from entering the connector.

According to a fifth aspect of the present invention, the engaging member may include an elastic arm portion and an engaging claw disposed on the elastic arm portion. Accordingly, the elastic arm elastically deforms and locks to a protrusion through a one-touch operation.

In the fifth aspect of the present invention, the connector guide member is attached in advance to the connector before the connector is mounted on the circuit board. Accordingly, it is possible to produce a connector device equipped with the connector guide member, and thereby it is easier to handle the connector upon mounting the connector onto the circuit board.

In a sixth aspect of the present invention, an electrical connector device may include the connector guide member described above and attached to the connector.

According to the invention, it is possible to directly attach the connector guide member to the connector without having the circuit board therebetween. Accordingly, the positioning can be accurate, and the attachment work can be extremely simpler. In addition, the connector guide member may be optionally attached to the connector as necessary. Accordingly, it is possible to keep a cost low by not having the connector guide member if unnecessary and keep the necessary space small, and it is easier to arrange peripheral electronic components.

BRIEF DESCRIPTION OF THE DRAWINGS

FIGS. 1(A) and 1(B) are perspective views showing a connector guide member and a connector according to a first embodiment of the present invention, wherein FIG. 1(A) is a perspective view showing the connector guide member and the connector before the connector guide member is assembled in the connector, and FIG. 1(B) is a perspective view showing the connector guide member and the connector after the connector guide member is assembled in the connector;

FIGS. 2(A) and 2(B) are perspective views showing the connector and a mating connector according to the first embodiment of the present invention, wherein FIG. 2(A) is a perspective view showing the connector and the mating connector before the connector is connected to the mating connector, and FIG. 2(B) is a perspective view showing the connector and the mating connector after the connector is connected to the mating connector;

FIGS. 3(A) and 3(B) are perspective views showing a connector guide member and a connector according to a second embodiment of the present invention, wherein FIG. 3(A) is a perspective views showing the connector guide member and the connector according to the second embodiment of the present invention, and FIG. 3(B) is a perspective views showing the connector guide member and the connector according to a modified example of the second embodiment of the present invention;

FIGS. 5(A) and 5(B) are perspective views showing a connector guide member and a connector according to a fourth embodiment of the present invention, wherein FIG. 5(A) is a perspective view showing the connector guide member and the connector when a shutter member is closed, and FIG. 5(B) is a perspective view showing the connector guide member and the connector when the shutter member is open.

DETAILED DESCRIPTION OF THE PREFERRED EMBODIMENTS

Hereunder, embodiments of the invention will be described with reference to the accompanying drawings.

First Embodiment

Figure 1A:
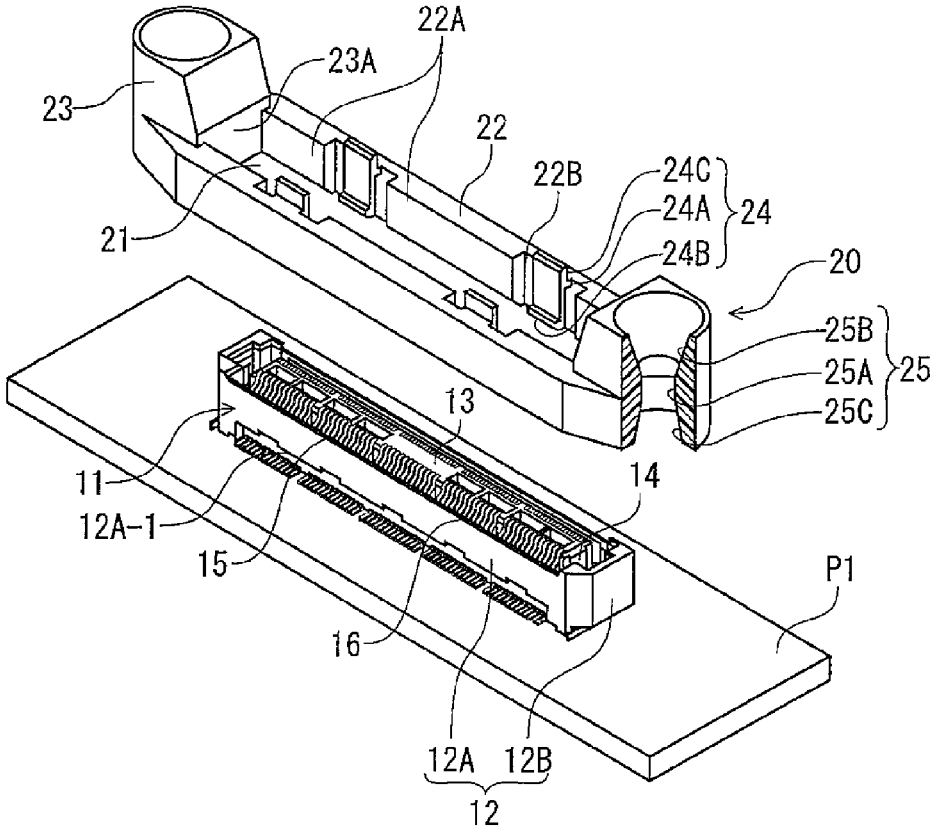
Figure 1B:
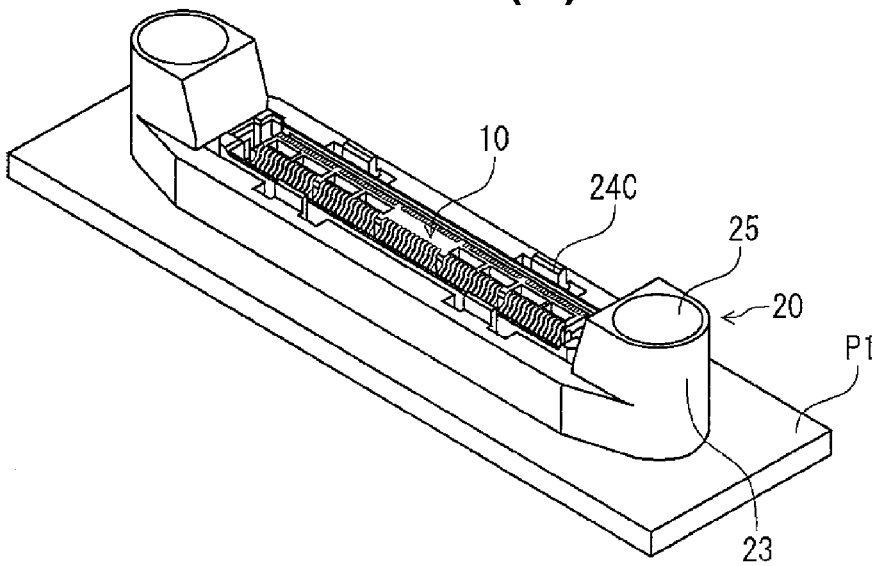

A first embodiment of the present invention will be explained. FIGS. 1(A) and 1(B) are perspective views showing a connector guide member 20 and a connector 10 according to the first embodiment of the present invention. More specifically, FIG. 1(A) is a perspective view showing the connector guide member 20 and the connector 10 before the connector guide member 20 is assembled in the connector 10, and FIG. 1(B) is a perspective view showing the connector guide member 20 and the connector 10 after the connector guide member 20 is assembled in the connector 10.

As shown in FIGS. 1(A) and (B), the connector 10 is mounted on a circuit board P1, and the connector guide member 20 is about to be attached in the connector 10.

In the embodiment, the connector 10 has a housing 11 having a generally rectangular thin solid in an outer appearance. The housing 11 includes a receiving recess 14 to receive a mating connector, which is circumferentially formed therearound between a circumferential wall 12, which consists of side walls 12A and end walls 12B, and a center wall 13 formed like an island in the space surrounded by the circumferential wall 12. On a surface on the receiving recess 14 side of the center wall 13, signal terminals 15 are arranged, whereas, on a surface on the receiving recess 14 side of the side wall 12A, a ground plate 16 is provided. The signal terminals 15 and the ground plate 16 are connected by soldering at their respective connecting sections to respective corresponding circuit units of a circuit board P1.

The lower end of the side wall 12A of the housing 11 is cut to form a gap from the circuit board P1, and its lower end has a section to be locked 12A-1 to which a locking claw of the connector guide member 20, which will be described later, locks.

The connector guide member 20 attached to the connector 10 has a frame-like shape, in which the fitting hole 21 that contacts by face with the circumferential wall 12 of the connector 10 is formed as a positioning section. The connector guide member 20 has a pair of side walls 22 that are provided along the side walls 12A of the connector 10 and columnar sections 23 that directly connect the side walls 22 at their ends.

The fitting hole 21 works as a positioning section to position the connector guide member 20 in relative to the connector 10, and the fitting hole 21 has flat face-contacting surfaces 22A and 23A, which respectively contact by face with the side walls 12A and the end walls 12B of the connector 10, and recesses 22B, which are dents on a face-contacting section 22A. Each recess 22B has a generally flat elastic arm 24, which protrudes upward from a basal section 24A joined to an upper portion of a bottom face of the recess 22B and extends downward.

A lower end of the elastic arm 24 has as a locking section a locking claw 24B that is directed inward of the fitting hole 21. When the elastic arm 24 is in the free state, a flat surface that is formed above the locking claw 24B is provided in the recess 22B so as to be recessed in relative to the face-contacting section 22A, and the locking claw 24B protrudes more than the face-contacting section 22A. A portion, which protrudes above the basal section 24A of the elastic arm 24, works as a pressing pressure release section 24C.

When the connector guide member 20 fits onto a circumferential surface of the connector 10 at the fitting hole 21 from thereabove, while the locking claw 24B is pressed by an outer surface of the side wall 12A of the connector 10, the elastic arm 24 elastically deforms inward of the recess 22B and thereby the fitting can progress. Once the connecter fits to a specific position, the locking claw 24B crosses the section to be locked 12A-1, which is a lower end of the side wall 12A of the housing 11, becomes to the free state, and thereby located outside the recess 22B. Therefore, the locking claw 24B locks to the section to be locked 12A-1, and thereby prevents the connector guide member 20 from coming off thereabove.

Upon releasing the locking, by pressing the pressing pressure release section 24C, which is formed as an upper portion of the elastic arm 24, inward of the fitting hole 21, the locking claw 24B elastically deforms inward of the recess 22B with the basal section 24A being the fulcrum, and thereby the locking is released. If the connector guide member 20 is lifted from the state, it comes off from the connector 10. Here, the locking of the connector guide member to the housing may not be limited by those examples shown in the figures and may be modified, altered, or varied in another embodiment.

Each columnar section 23 is formed protruding above than an upper surface of the side walls 22, and have a guide hole 25 as a guide section, which is provided through therein along the vertical direction. The guide hole 25 has a cylindrical surface section 25A with the minimum diameter at the middle position in the vertical direction, and has an upper tapered surface 25B thereabove and a lower tapered surface 25C therebelow, where the diameter increases upward and downward, respectively.

The inner diameter of the cylindrical surface section 25A is set to fit to the diameter of the guide pin, which is a section to be guided on the mating connector as will be described later. Accordingly, the guide hole 25 easily introduces a guide pin by the upper tapered surface section 25B and accurately places in a position by the cylindrical surface section 25A. If the guide pin is somewhat tilted, such tilt of the guide pin may be allowed by the upper tapered surface section 25B and the lower tapered surface section 25C with the cylindrical surface section 25A being the fulcrum.

The connector guide member 20 formed in this way is attached to the connector 10 that is already mounted on the circuit board P1, by fitting to the fitting hole 21, and is prevented from coming off by locking the locking claw of the elastic arm 24 to the section to be locked in the connector 12A-1. In this manner, the connector device as shown in FIG. 1(B) is formed with the connector 10 and the connector guide member 20. Here, the connector guide member 20 may be attached to the connector prior to mounting the connector 10 to the circuit board P1, and thereby forms a connector device by being combined with the connector 10.

Figure 2A:
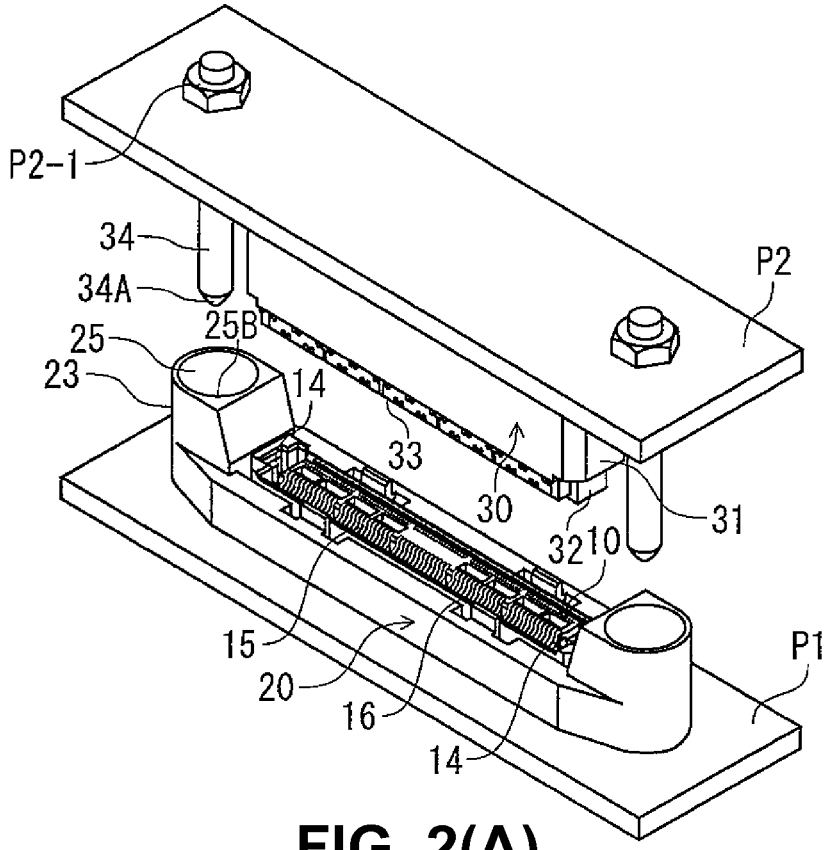
Figure 2B:
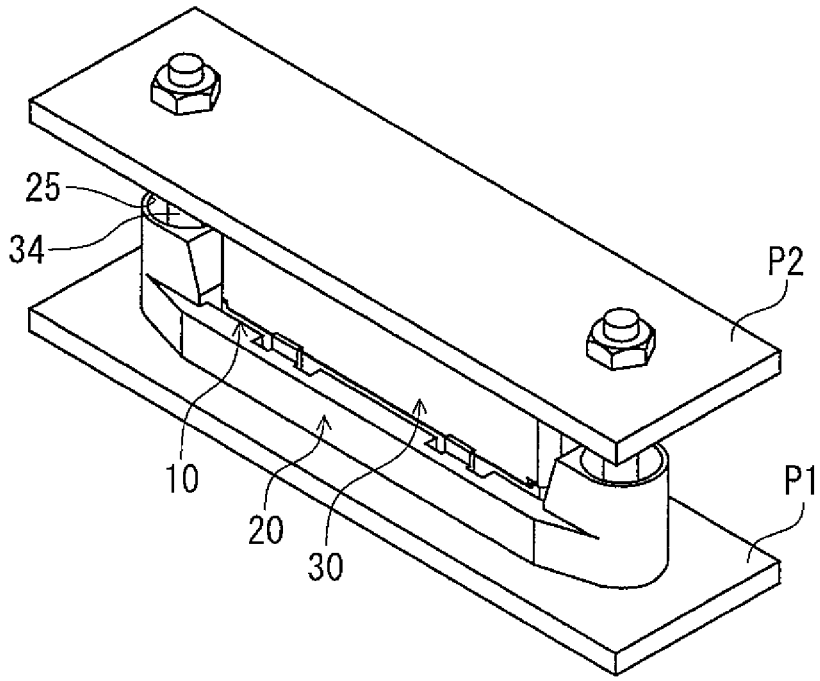

FIGS. 2(A) and 2(B) are perspective views showing the connector 10 and a mating connector 30 according to the first embodiment of the present invention. More specifically, FIG. 2(A) is a perspective view showing the connector 10 and the mating connector 30 before the connector 10 is connected to the mating connector 30, and FIG. 2(B) is a perspective view showing the connector 10 and the mating connector 30 after the connector 10 is connected to the mating connector 30.

As shown in FIG. 2(A), the mating connector 30 is attached to another circuit board P2. The housing 31 of the mating connector 30 has an insertion section 32 that enters the receiving recess 14 of the connector 10, and the insertion section 32 has signal terminals (not illustrated) to be connected to the signal terminals 15 of the connector 10 and a ground plate 33 to be connected to the ground plate 16 of the connector 10.

Near the both ends of the mating connector 30, the circuit board P2 has guide pins 34 as sections to be guided in the mating connector 30 at positions corresponding to the guide holes 25 of the connector guide member 20 for the connector 10. The guide pins 34 are attached the circuit board P2 by nuts P2-1 on the backside (upper surface side in FIG. 2(A)) of the circuit board P2, and extends in the direction of the connector 10. An end of each guide pin 34 has a tapered section 34A and the length of the guide pin 34 is set so that the tapered section 34A can reach the position of the lower tapered surface section 25C of each guide hole 25 of the connector guide member 20 upon fitting of the mating connector 30 to the connector 10.

The mating connector 30 mounted on another circuit board P2 in this way will be connected by fitting to the connector 10, which is mounted on one circuit board P1, in the following manner.

First, an operator holds the other circuit board P2 with his/her hand and position the guide pins 34 so as to be above the guide holes 25 of the connector guide member 20 attached to the connector 10. At this time, one circuit board P1 is horizontal to the other circuit board P2, but the columnar section 23 having the guide holes 25 formed thereon is higher than the connector 10 and the guide pins 34 protrude more than the mating connector 30. Therefore, it is possible to easily see the columnar sections 23 and the guide pins 34 by visual observation from between the two circuit boards P1 and P2.

In this state, bring the other circuit board P2 down. Since the end of each guide pin 34 is tapered and is thin and the upper tapered surface section 25B of each guide hole 25 has larger diameter upward as shown in FIG. 1(A), the guide pin 34 is easily introduced into the upper tapered surface section 25B even if it is slightly off-positioned. By further bringing the other circuit board P2 down, each guide pin 34 reaches the cylindrical surface section 25A of the guide hole 25, at this point, the guide pin 34 is brought to a correct position in the radial direction, and the connector 30 is brought to a fitting position in relative to the connector 10. Then, pushing the connector 30 to the connector 10 via the other circuit board P2, the connectors 10 and 30 fit to each other without difficulties (see FIG. 2(B)).

In the embodiment, the guide pin(s) 34 may be slightly tilted from the normal position. As shown in FIG. 1(A), since each guide hole 25 has an upper tapered surface section 25B and the lower tapered surface section 25C above and under the cylindrical surface section 25A, the connectors 10 and 30 can fit to each other with the cylindrical surface section 25A being a fulcrum, while allowing the tilt of the guide pin 34.

Second Embodiment

A second embodiment of the present invention will be explained next.

Figure 3A:
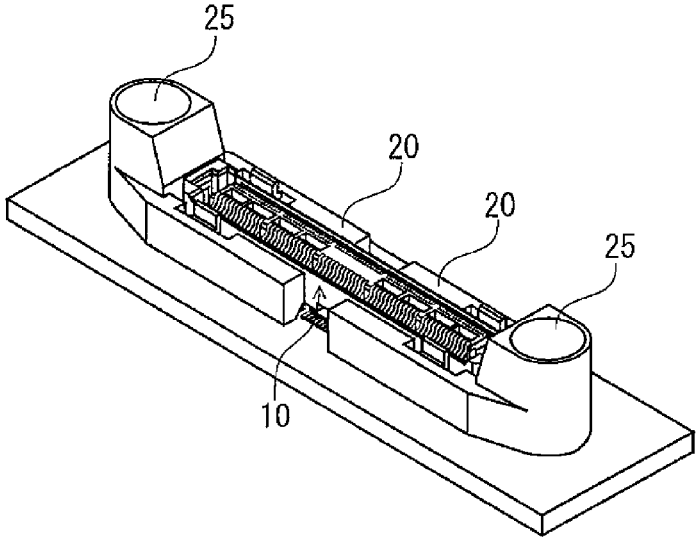
Figure 3B:
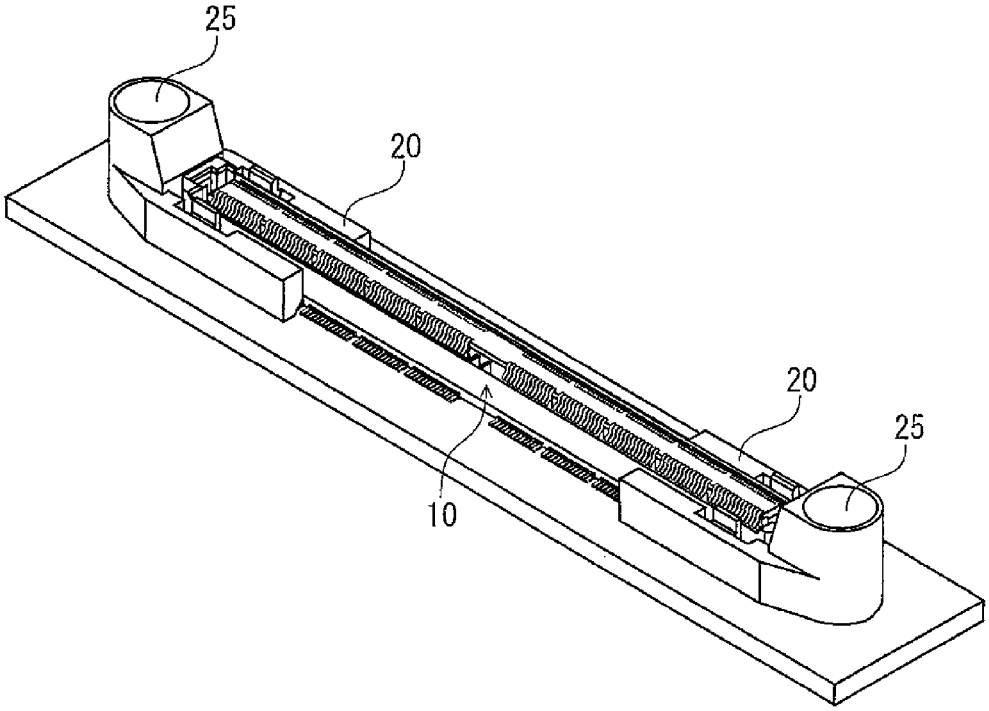

FIGS. 3(A) and 3(B) are perspective views showing the connector guide member 20 and the connector 10 according to the second embodiment of the present invention. More specifically, FIG. 3(A) is a perspective views showing the connector guide member 20 and the connector 10 according to the second embodiment of the present invention, and FIG. 3(B) is a perspective views showing the connector guide member 20 and the connector 10 according to a modified example of the second embodiment of the present invention.

While the connector guide member 20 is a component formed surrounding the whole periphery of the connector 10, the connector guide member 10 is divided in two according to the second embodiment as shown in FIGS. 3(A) and 3(B).

One connector guide member 20 is provided on the one end side of the connector 10 and has a face-contacting section only at about a half portion of the connector 10. However, because of its face-contacting with the end walls 12B of the connector 10 on the one end side and about a half length in relative to both side walls 12A, the connector guide member 20 is attached to the connector 10 in any direction with the normal position being secured. By respectively attaching the connector guide member 20 onto the both end sides of the connector 10, the guide holes 25 of the two connector guide member 20 will be brought fully to the normal position in relative to the two guide pins of the mating connector.

In the embodiment, as shown in FIGS. 3(A) and (B), it is advantageous that it is possible to use the same connector guide member 20 in different connectors, which differ only in the number of terminals and are the same in the shapes at the both end sections of the circumferential walls 12.

Third Embodiment

Figure 4:
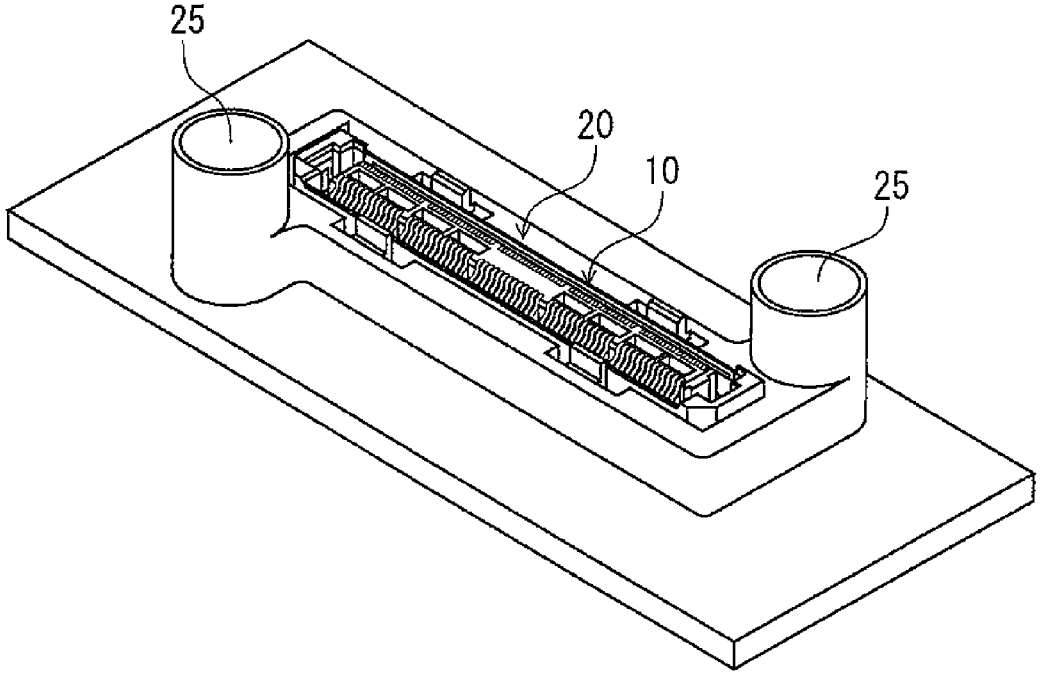
FIG. 4 is a perspective views showing a connector guide member and a connector according to a third embodiment of the present invention.

A third embodiment of the present invention will be explained next. FIG. 4 is a perspective views showing the connector guide member 20 and the connector 10 according to the third embodiment of the present invention.

The position of each guide hole 25 as a guide section of the connector guide member 20 may not have to be adjacent to the end surface of the end wall 12B of the connector 10, but instead, may be adjacent to the end portion of the side wall 12A.

As shown in FIG. 4, the two guide holes 25 are disposed on a diagonal line in relative to the connector 10. With the configuration, when there is no enough space on the end surface side of the end wall 12B on the circuit board, or even if the connector 10 is short having not so many terminals, it is advantageous to stabilize the position securing large distance between the guide holes 25.

In the embodiment, it is possible to modify by dividing the connector guide member into two so as to provide on the both end sections of the connector 10, so as to be able to use commonly for different types of connectors, which differ in the number of terminals.

Fourth Embodiment

A fourth embodiment of the present invention will be explained next.

Figure 5A:
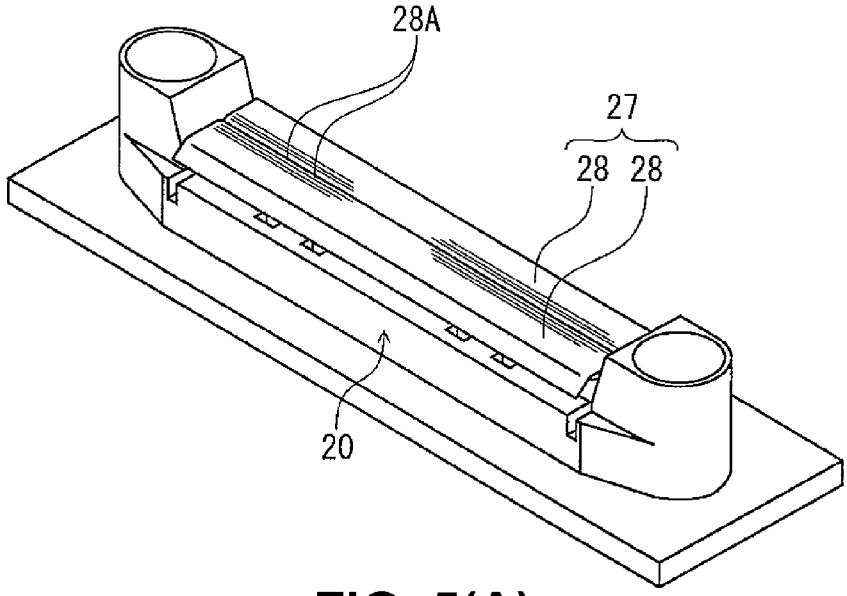
Figure 5B:
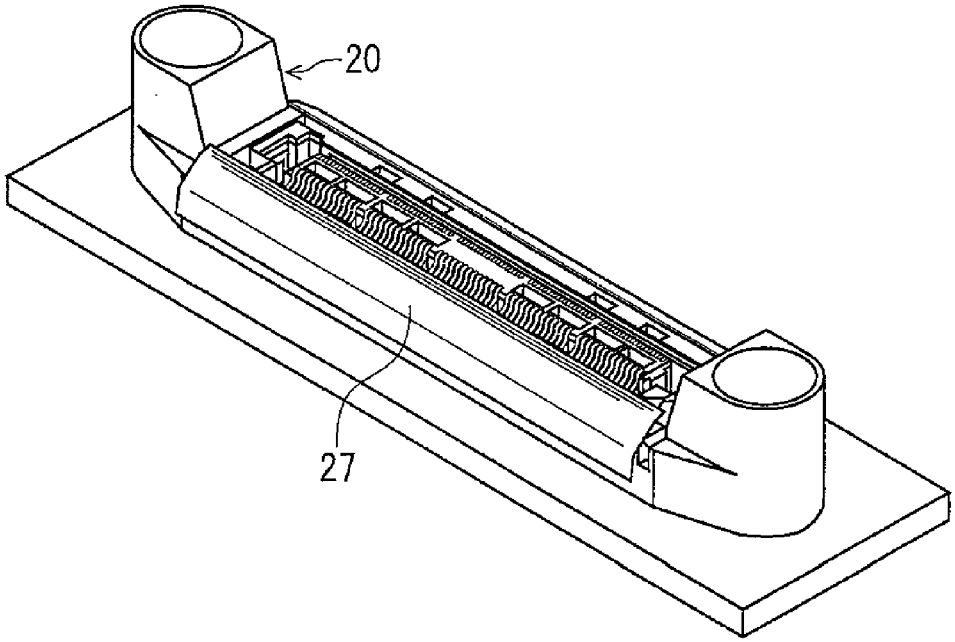

FIGS. 5(A) and 5(B) are perspective views showing the connector guide member 20 and the connector 10 according to the fourth embodiment of the present invention. More specifically, FIG. 5(A) is a perspective view showing the connector guide member 20 and the connector 10 when a shutter member 27 is closed, and FIG. 5(B) is a perspective view showing the connector guide member 20 and the connector 10 when the shutter member 27 is open.

The connector guide member 20 may have another function in addition to guiding the mating connector. For example, as shown in FIGS. 5(A) and 5(B), it is possible to attach the shutter member 27 on an upper opening of the connector guide member 20, and thereby the shutter member 27 can prevent intrusion of dust into the connector 10 when the connector is not used until fitting to the mating connector.

As shown in FIG. 5(A), for example, the shutter member 27 may have two members 28, and when the connector is not used, contacting each other by a spring (not illustrated), the upper opening of the connector guide member 20 is closed, and the tapered edges 28A formed at the contacting edge sections of the two members 28 are pushed away from each other (see FIG. 5(B) in which the mating connector is omitted), and the mating connector is fitted to the connector 10 therebetween. Once the mating connector is pulled out, the two members 28 contact to each other by force from the spring and thereby close the upper opening.

Fifth Embodiment

Figure 6:
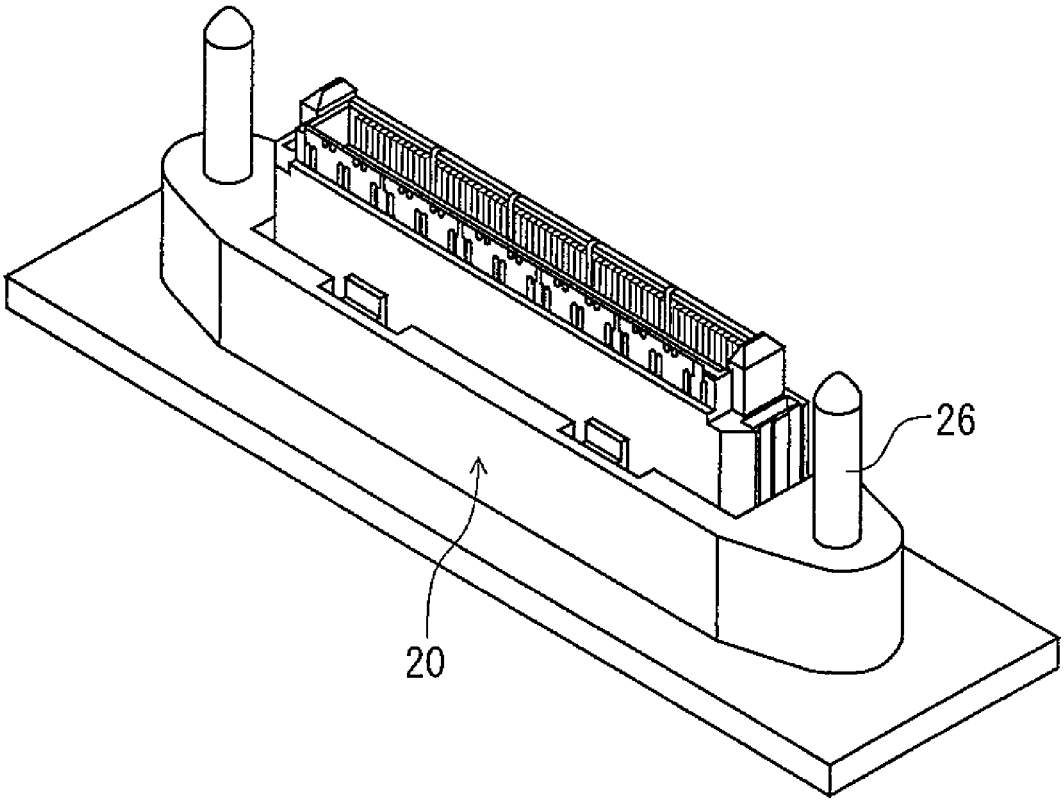
FIG. 6 is a perspective views showing a connector guide member and a connector according to a fifth embodiment of the present invention.

A fifth embodiment of the present invention will be explained next. FIG. 6 is a perspective views showing the connector guide member 20 and the connector 10 according to the fifth embodiment of the present invention.

In the connector guide members in the embodiments shown in FIGS. 1(A), 1(B) through 5(A), 5(B), the guide section is formed as a guide hole so as to accept a guide pin of the mating connector, but it is also possible to switch the guide hole and guide pin to provide between the connector and the mating connector.

In the embodiment, as shown in FIG. 6, the connector guide member 20 has guide pins 26 as guide sections on the both end sections. The guide pins 26 themselves may be the same as the guide pins 34 of the mating connector 30 shown in FIGS. 2(A) and 2(B). Therefore, the corresponding section to be guided on the mating connector 30 may be embodied in the same way as the guide holes 25 of the connector guide member 20 shown in FIGS. 1(A), 1(B) and 2(A), 2(B).

The disclosure of Japanese Patent Application No. 2009-289049, filed on Dec. 21, 2009 is incorporated in the application by reference.

While the invention has been explained with reference to the specific embodiments of the invention, the explanation is illustrative and the invention is limited only by the appended claims.

What is claimed is:

1. A connector guide member for guiding a connector mounted on a circuit board to a mating connector when the connector is connected to the mating connector, comprising:

a positioning member to be mounted on the circuit board for positioning the connector guide member relative to the connector; said position member being formed in a rectangular frame shape for surrounding an entire outer circumference of the connector;

an engaging member for engaging the connector;

a columnar section disposed at an end portion of the positioning member; and a guiding member disposed on the columnar section for guiding a guided portion disposed on the mating connector, wherein said positioning member includes an engaging hole contacting with an outer surface of the connector, and said columnar section having a height from the circuit board greater than that of the positioning member when the connector guide member is attached to the connector on the circuit board.

2. The connector guide member according to claim 1, wherein said guiding member includes a guide hole for receiving a guide pin disposed on the mating connector as the guided portion.

3. The connector guide member according to claim 1, wherein said guiding member includes a guide pin for inserting into a guide hole formed in the mating connector as the guided portion.

4. The connector guide member according to claim 1, wherein said positioning member includes an attaching surface contacting with an outer surface of the connector.

5. The connector guide member according to claim 1, wherein said positioning member further includes a shutter member disposed on an opening portion of the engaging hole for closing the engaging hole before the connector is connected to the mating connector.

6. The connector guide member according to claim 1, wherein said engaging member includes an elastic arm portion and an engaging claw disposed on the elastic arm portion.

7. An electrical connector device comprising the connector guide according to claim 1.

8. The connector guide member according to claim 1, wherein said positioning member has the height from the circuit board smaller than that of the connector so that the connector is exposed from the positioning member when the connector guide member is attached to the connector on the circuit board.

* * * * *